US006899641B2

(12) United States Patent
Watanabe

(10) Patent No.: US 6,899,641 B2
(45) Date of Patent: May 31, 2005

(54) MULTI-PIECE SOLID GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/755,360

(22) Filed: Jan. 13, 2004

(65) Prior Publication Data

US 2004/0142770 A1 Jul. 22, 2004

Related U.S. Application Data

(62) Division of application No. 10/236,044, filed on Sep. 5, 2002, now Pat. No. 6,702,694.

(51) Int. Cl.[7] ..... A63B 37/04; A63B 37/06; A63B 37/12; A63B 37/14

(52) U.S. Cl. ..... 473/371; 473/378

(58) Field of Search ..... 473/351–378

(56) References Cited

U.S. PATENT DOCUMENTS

| | | | | |
|---|---|---|---|---|
| 4,387,181 A | * | 6/1983 | Brown et al. | 524/714 |
| 5,779,563 A | * | 7/1998 | Yamagishi et al. | 473/371 |
| 5,782,707 A | | 7/1998 | Yamagishi et al. | |
| 5,820,487 A | | 10/1998 | Nakamura et al. | |
| 5,830,085 A | | 11/1998 | Higuchi et al. | |
| 6,129,640 A | | 10/2000 | Higuchi et al. | |
| 6,267,694 B1 | | 7/2001 | Higuchi et al. | |
| 6,520,872 B2 | | 2/2003 | Endo et al. | |
| 6,551,202 B1 | * | 4/2003 | Yoshida | 473/376 |
| 6,558,275 B2 | * | 5/2003 | Ohama | 473/373 |

FOREIGN PATENT DOCUMENTS

| | | |
|---|---|---|
| JP | 7-024085 A | 1/1995 |
| JP | 11-104273 A | 4/1999 |

* cited by examiner

*Primary Examiner*—Stephen Blau
*Assistant Examiner*—Alvin A. Hunter, Jr.
(74) *Attorney, Agent, or Firm*—Sughrue Mion, PLLC

(57) ABSTRACT

A multi-piece solid golf ball comprising a core, an intermediate layer enclosing the core, and an outer layer enclosing the intermediate layer is characterized in that the intermediate layer is made of a thermoplastic resin composition, the intermediate layer on its surface has a Shore D hardness of at least 57, the intermediate layer has a specific gravity of 1.00–1.30 g/cm$^3$, the outer layer has a specific gravity of at least 1.00 g/cm$^3$, the core has a specific gravity of 1.05–1.20 g/cm$^3$, the intermediate layer and the outer layer have a total gauge of up to 3.3 mm, [(core surface JIS-C hardness)–(core center JIS-C hardness)]≧16, [(intermediate layer surface JIS-C hardness)–(core surface JIS-C hardness)]≧0, and −18≦[(outer layer surface Shore D hardness)–(intermediate layer surface Shore D hardness)]<0.

14 Claims, 1 Drawing Sheet

MULTI-PIECE SOLID GOLF BALL

This is a divisional of application Ser. No. 10/236,044 filed Sep. 5, 2002 now U.S. Pat. No. 6,702,694; the disclosure of which is incorporated herein by reference.

BACKGROUND OF THE INVENTION

This invention relates to a multi-piece solid golf ball offering satisfactory distance, feel on impact and controllability, and having improved crack durability against repeated shots and improved scuff resistance.

Golf balls of various structures are known in the art. In particular, a number of proposals have been made on solid golf balls, inter alia, multi-piece solid golf balls having a core enclosed with a plurality of layers on account of flight distance, controllability (or spin rate) and feel.

JP-A 7-24085 proposes a golf ball having an outer layer and an intermediate layer which are both made of low specific gravity ionomer cover stocks, but leaving problems with respect to impact durability against repeated shots and scuff resistance.

JP-A 11-104273 proposes a golf ball having an outer layer which is a high specific gravity urethane cover and an intermediate layer which is an ionomer layer. Since the hardnesses of the respective layers are insufficiently optimized and the materials used are insufficient to satisfy the desired performance, there are left problems in satisfying all the factors of flight, feel, controllability, impact durability and scuff resistance.

SUMMARY OF THE INVENTION

An object of the present invention is to provide a multi-piece solid golf ball which satisfies all the factors of flight, feel and controllability required by ordinary amateur users who intend to play in competition, and offers both shot durability against repeated shots and scuff resistance at a high level.

Making extensive investigations to attain the above object, the inventor has discovered with respect to a multi-piece solid golf ball comprising a core, an intermediate layer enclosing the core, and an outer layer or cover enclosing the intermediate layer, that a golf ball satisfying all the factors of flight, feel, controllability, crack durability and scuff resistance is obtained by using a thermoplastic resin composition in the intermediate layer, and optimizing the Shore D hardness of intermediate layer surface, intermediate layer's specific gravity, outer layer's specific gravity, core's specific gravity, the total gauge of intermediate layer and outer layer, a hardness difference between core surface JIS-C hardness and core center JIS-C hardness, a hardness difference between intermediate layer surface JIS-C hardness and core surface JIS-C hardness, and a hardness difference between outer layer surface Shore D hardness and intermediate layer surface Shore D hardness. The present invention is predicated on this discovery.

Accordingly, the invention provides a golf ball as defined below.

[I] A multi-piece solid golf ball comprising a core, an intermediate layer enclosing the core, and an outer layer enclosing the intermediate layer, characterized in that the intermediate layer is made of a thermoplastic resin composition, the intermediate layer on its surface has a Shore D hardness of at least 57, the intermediate layer has a specific gravity of 1.00 to 1.30 g/cm$^3$, the outer layer has a specific gravity of at least 1.00 g/cm$^3$, the core has a specific gravity of 1.05 to 1.20 g/cm$^3$, the intermediate layer and the outer layer have a total gauge of up to 3.3 mm, the core at its surface and center, the intermediate layer at its surface, and the outer layer at its surface have hardnesses satisfying: [(core surface JIS-C hardness)−(core center JIS-C hardness)]≧16, [(intermediate layer surface JIS-C hardness)−(core surface JIS-C hardness)]≧0, and −18≦[(outer layer surface Shore D hardness)−(intermediate layer surface Shore D hardness)]<0.

[II] The multi-piece solid golf ball of [I] wherein the core center has a JIS-C hardness of 54 to 66, and the core surface has a JIS-C hardness of 72 to 95.

[III] The multi-piece solid golf ball of [I] or [II] wherein the outer layer is made of a polyurethane composition.

[IV] The multi-piece solid golf ball of [I], [II] or [III] wherein said thermoplastic resin composition comprises a thermoplastic resin and an inorganic particulate filler in a proportion of 100/5 to 100/25 by weight ratio.

[V] The multi-piece solid golf ball of [IV] wherein said thermoplastic resin composition comprises (A) an ionomer resin component which contains (a-1) an olefin/unsaturated carboxylic acid random bipolymer and/or a metal ion neutralization product of an olefin/unsaturated carboxylic acid random bipolymer and (a-2) an olefin/unsaturated carboxylic acid/unsaturated carboxylic acid ester random terpolymer and/or a metal ion neutralization product of an olefin/unsaturated carboxylic acid/unsaturated carboxylic acid ester random terpolymer, and (B) a non-ionomer thermoplastic elastomer.

[VI] The multi-piece solid golf ball of [IV] or [V] wherein said thermoplastic resin composition comprises (A) the ionomer resin component which contains components (a-1) and (a-2) in a proportion (a-1)/(a-2) of 100/0 to 25/75 by weight ratio, and (B) the non-ionomer thermoplastic elastomer in a proportion (A)/(B) of 100/0 to 50/50 by weight ratio.

[VII] The multi-piece solid golf ball of any one of [III] to [VI] wherein said polyurethane composition contains (C) a thermoplastic polyurethane and (D) an isocyanate mixture, said isocyanate mixture (D) is a mixture prepared by dispersing (d-1) a compound having as functional groups at least two isocyanate groups per molecule in (d-2) a thermoplastic resin that is substantially non-reactive with isocyanate.

[VIII] The multi-piece solid golf ball of any one of [I] to [VIII] wherein said core has a two-layer structure.

[IX] The multi-piece solid golf ball of any one of [I] to [VIII] wherein [(core surface JIS-C hardness)−(core center JIS-C hardness)]≧20.

DETAILED DESCRIPTION OF THE INVENTION

Figure 1:
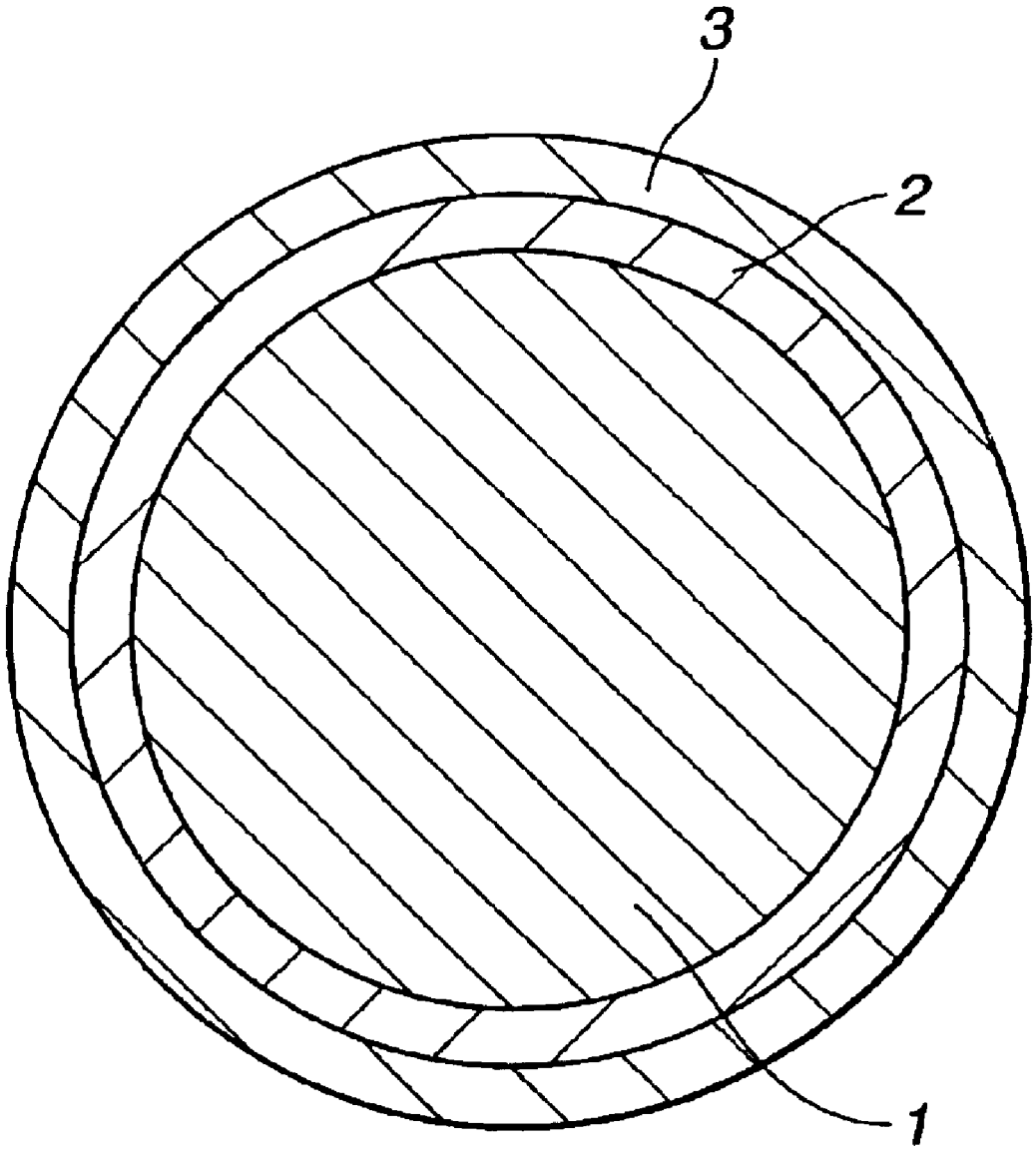
FIG. 1 is a schematic sectional view showing a golf ball according to one embodiment of the invention.

The invention is described more fully below.

Referring to FIG. 1, there is shown a multi-piece solid golf ball according to one embodiment of the invention. The multi-piece solid golf ball of the invention has a core 1, an intermediate layer 2 enclosing the core 1, and an outer layer or cover 3 enclosing the intermediate layer 2. Each of the core 1, intermediate layer 2 and outer layer 3 may include more than one layer.

The core used herein can be formed using a rubber composition containing, for example, a co-crosslinking agent, an organic peroxide, an inert filler and an organosulfur compound. The base rubber of the rubber composition is preferably composed primarily of polybutadiene.

The polybutadiene used herein is not critical. Any polybutadiene used in conventional golf ball cores may be employed, although cis-1,4-polybutadiene containing at least 40 wt % of cis structure is preferred. If desired, natural rubber, polyisoprene rubber, styrene-butadiene rubber or the like may be blended with polybutadiene to form the base rubber.

Exemplary co-crosslinking agents include unsaturated carboxylic acids and metal salts of unsaturated carboxylic acids.

Examples of unsaturated carboxylic acids include acrylic acid, methacrylic acid, maleic acid and fumaric acid. Acrylic acid and methacrylic acid are especially preferred.

The metal salts of unsaturated carboxylic acids are not critical. For example, any of the above-mentioned unsaturated carboxylic acids neutralized with the desired metal ions may be used. Specific examples include zinc and magnesium salts of methacrylic acid, acrylic acid or the like. Zinc acrylate is especially preferred.

The unsaturated carboxylic acids and/or metal salts thereof are generally used in an amount, per 100 parts by weight of the base rubber, of at least 10 parts by weight, preferably at least 15 parts by weight, and more preferably at least 20 parts by weight, but not more than 60 parts by weight, preferably not more than 50 parts by weight, more preferably not more than 45 parts by weight, and most preferably not more than 40 parts by weight. Too much tends to give the golf ball too hard a feel upon impact that is difficult to endure, whereas too little may diminish resilience.

Commercial products may be used as the organic peroxide. Suitable examples include Percumil D (manufactured by NOF Corporation), Perhexa 3M-40 (manufactured by NOF Corporation) and Luperco 231XL (manufactured by Atochem Co.). These peroxides may be used alone or in admixture of two or more.

The organic peroxide is generally included in an amount, per 100 parts by weight of the base rubber, of at least 0.1 part by weight, preferably at least 0.3 part by weight, more preferably at least 0.5 part by weight, and most preferably at least 0.7 part by weight, but not more than 5 parts by weight, preferably not more than 4 parts by weight, more preferably not more than 3 parts by weight, and most preferably not more than 2 parts by weight. Too much or too little organic peroxide may fail to achieve a good feel upon impact, durability and resilience.

Examples of inert fillers that may be used include zinc oxide, barium sulfate and calcium carbonate. These fillers may be used alone or in admixture of two or more.

The inert filler is generally included in an amount, per 100 parts by weight of the base rubber, of at least 5 parts by weight, and preferably at least 7 parts by weight, but not more than 50 parts by weight, preferably not more than 40 parts by weight, more preferably not more than 30 parts by weight, and most preferably not more than 20 parts by weight. Too much or too little inert filler may fail to achieve an appropriate weight and good resilience.

It is preferable for the core of the golf ball to include an organosulfur compound so as to enhance the rebound characteristics and increase the initial velocity of the ball.

Exemplary organosulfur compounds include thiophenols, thionaphthols, halogenated thiophenols, and metal salts thereof, and polysulfides. Specific examples of suitable organosulfur compounds used herein include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and polysulfides having 2 to 4 sulfur atoms, such as diphenylpolysulfides, dibenzylpolysulfides, dibenzoylpolysulfides, dibenzothiazoylpolysulfides and dithiobenzoylpolysulfides. Of these, the zinc salt of pentachlorothiophenol is especially preferred. They may be used alone or in admixture of two or more.

It is recommended that the organosulfur compound be included in an amount, per 100 parts by weight of the base rubber, of generally at least 0.05 part by weight, preferably at least 0.1 part by weight, and most preferably at least 0.2 part by weight, but generally not more than 5 parts by weight, preferably not more than 4 parts by weight, more preferably not more than 3 parts by weight, and most preferably not more than 2.5 parts by weight. Too much organosulfur compound may cause the effects of addition to reach a point at which no further improvement occurs, whereas too little addition may fail to fully achieve the desired effects.

If necessary, the rubber composition may include also an antioxidant, suitable examples of which include such commercial products as Nocrac NS-6 and Nocrac NS-30 (made by Ouchi Shinko Chemical Industry Co., Ltd.), and Yoshinox 425 (made by Yoshitomi Pharmaceutical Industries, Ltd.). They may be used alone or in admixture of two or more.

The antioxidant is generally included in an amount, per 100 parts by weight of the base rubber, of at least 0 part by weight, preferably at least 0.05 part by weight, more preferably at least 0.1 part by weight, and most preferably at least 0.2 part by weight, but not more than 3 parts by weight, preferably not more than 2 parts by weight, more preferably not more than 1 part by weight, and most preferably not more than 0.5 part by weight. Too much or too little antioxidant may fail to achieve good resilience and durability.

Besides the above-mentioned organosulfur compound, a mixture of sulfur and a metal salt, for example, a mixture of sulfur and zinc white may be added.

The core can be produced by subjecting the rubber composition containing the various above constituents to vulcanization and curing by a known method. Typically, the rubber composition is worked with a mixing apparatus such as a Banbury mixer or a roll mill, then compression molded or injection molded in a core mold. The molded composition is then cured by appropriate heating at a temperature sufficient for the organic peroxide and the co-crosslinking agent to act. When dicumyl peroxide is used as the organic peroxide and zinc acrylate is used as the co-crosslinking agent, for example, heating is generally carried out at about 130 to 190° C., and preferably 150 to 180° C., for 10 to 40 minutes, and preferably 12 to 20 minutes.

The core used herein should have a specific gravity set in a range of 1.05 to 1.20 g/cm$^3$, preferably 1.07 to 1.15 g/cm$^3$, and more preferably 1.09 to 1.13 g/cm$^3$. Too low a specific gravity may make it substantially impossible to set up a sufficient formulation to provide good flight whereas too high a specific gravity may diminish resilience on account of a reduced rubber fraction, failing to provide distance.

With respect to the structure of the core used herein, it may be formed to a single layer structure or a plural layer structure. For spin rate adjustment, it is preferred to form the core from a plurality of layers, especially two layers. In the case of a plural layer core, the core's specific gravity means the specific gravity of a sphere in which a center core is enclosed with an outer core.

According to the invention, the core generally has a surface hardness of 72 to 95, preferably 75 to 90, and more preferably 78 to 87, as expressed in JIS-C hardness units. The core generally has a center hardness of 54 to 66, preferably 56 to 64, and more preferably 58 to 63, as expressed in JIS-C hardness units. The average core hardness (which refers to the arithmetic mean of the core surface hardness and the core center hardness, hereinafter) is 63 to 81, preferably 65 to 77, more preferably 68 to 75 in JIS-C hardness units. If each of the foregoing hardnesses is too high, there may result too hard a feel upon impact and too much a spin rate on W#1 shots. If each of the foregoing hardnesses is too low, there may result too soft a feel upon impact, too low a resilience with a failure to provide travel distance, and too poor crack durability against repeated shots.

According to the invention, the value obtained by subtracting the core center hardness from the core surface hardness, expressed in JIS-C hardness units, is set to be at least 16, preferably at least 18, and more preferably at least 20, and its upper limit is preferably not more than 40, and more preferably not more than 30. If the value obtained by subtracting the core center hardness from the core surface hardness is too small, the ball, on shots with a driver (W#1), may take on too much spin and follow a skying trajectory, resulting in a reduced distance. On the other hand, if the value obtained by subtracting the core center hardness from the core surface hardness is too large, crack durability against repeated shots may be exacerbated and the resilience may diminish, resulting in decreased distance.

The hardness and specific gravity in each part of the core can be set within the above-indicated ranges by suitably selecting, for example, the types and amounts of materials formulated in the core, the types and amounts of organic peroxide and co-crosslinking agent included, and the vulcanizing conditions.

Preferably the core has a diameter of at least 36 mm, and most preferably at least 38 mm, but not more than 41 mm, and most preferably not more than 39 mm. Also preferably, the core has a weight of 30 to 35 g, and most preferably 31 to 34 g.

The intermediate layer used herein is formed of a thermoplastic resin composition, which preferably includes a thermoplastic resin and an inorganic particulate filler.

The thermoplastic resin is preferably one comprising (A) an ionomer resin component containing (a-1) an olefin/unsaturated carboxylic acid random bipolymer and/or a metal ion neutralization product of an olefin/unsaturated carboxylic acid random bipolymer and (a-2) an olefin/unsaturated carboxylic acid/unsaturated carboxylic acid ester random terpolymer and/or a metal ion neutralization product of an olefin/unsaturated carboxylic acid/unsaturated carboxylic acid ester random terpolymer, and (B) a non-ionomer thermoplastic elastomer.

The olefin in component (a-1) or (a-2) is preferably an α-olefin. Specific examples of suitable α-olefins include ethylene, propylene and 1-butene. Of these, ethylene is especially preferred. These olefins may also be used in combinations of two or more thereof.

The unsaturated carboxylic acid in component (a-1) or (a-2) is preferably an α,β-unsaturated carboxylic acid having 3 to 8 carbon atoms. Specific examples of α,β-unsaturated carboxylic acid having 3 to 8 carbon atoms include acrylic acid, methacrylic acid, ethacrylic acid, itaconic acid and maleic acid. Of these, acrylic acid and methacrylic acid are preferred. These unsaturated carboxylic acids may also be used in combinations of two or more thereof.

The unsaturated carboxylic acid ester in component (a-2) is preferably, but not limited to, a lower alkyl ester of the above-described unsaturated carboxylic acid. Specific examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, i-butyl acrylate) is especially preferred. These unsaturated carboxylic acid esters may be used in combinations of two or more thereof. Such unsaturated carboxylic acid esters help to improve the flexibility of the ionomer resin.

During preparation of the above-described olefin/unsaturated carboxylic acid copolymer or olefin/unsaturated carboxylic acid/unsaturated carboxylic acid ester copolymer, any additional monomer may be copolymerized insofar as the objects of the invention are not compromised.

These copolymers have an unsaturated carboxylic acid content of generally at least 4 mol %, preferably at least 6 mol %, more preferably at least 8 mol %, and most preferably at least 10 mol %, but generally not more than 30 mol %, preferably not more than 20 mol %, more preferably not more than 18 mol %, even more preferably not more than 15 mol %, and most preferably not more than 12 mol %. Too low an unsaturated carboxylic acid content may result in a low rigidity and resilience, diminishing the flight performance of the golf ball. Too high an unsaturated carboxylic acid content may result in an inadequate flexibility.

When a copolymer composed of an olefin and an unsaturated carboxylic acid as the chief monomers and a copolymer composed of an olefin, an unsaturated carboxylic acid and an unsaturated carboxylic acid ester as the chief monomers are blended together and used, it is preferable for these copolymers to be blended in a weight ratio of 100:0 to 25:75, and especially 100:0 to 50:50. The use of too much copolymer composed of an olefin, an unsaturated carboxylic acid and an unsaturated carboxylic acid ester as the chief monomers may result in an inadequate resilience.

The ionomer resin (A) used in the practice of the invention is preferably one obtained by neutralizing the above-described copolymer with at least one of mono- to trivalent metal ions. Examples of mono- to trivalent metal ions for neutralization include sodium, potassium, lithium, magnesium, calcium, zinc, aluminum, ferrous ions and ferric ions.

Such metal ions may be introduced by reacting the above-described copolymers with, for example, a hydroxide, methoxide, ethoxide, carbonate, nitrate, formate, acetate or oxide of the mono- to trivalent metals.

An appropriate degree of neutralization is preferably provided for the carboxylic acid included within the above copolymer such that at least 10 mol %, and especially at least 30 mol %, but not more than 100 mol %, and especially not more than 90 mol %, of the carboxyl groups on the copolymer are neutralized with metal ions. A low degree of neutralization may result in low resilience.

It is well-known that a good balance between resilience and durability can be achieved in a layer composed primarily of ionomer resin by blending suitable amounts of ionomer resins containing different monovalent, divalent or trivalent metal ionic species. Such blending is preferred in the practice of the invention.

Commercial products are available as the ionomer resin (A) used herein. Suitable examples of the metal ion neutralization products of random bipolymers in which the chief monomers are an olefin and an unsaturated carboxylic acid include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (produced by E. I. du Pont de Nemours and Co., Inc.) and Iotek 3110 and Iotek 4200 (both products of ExxonMobil Chemical). Suitable examples of the metal ion neutralization products of random terpolymers in which the chief monomers are an olefin, an unsaturated carboxylic acid and an unsaturated carboxylic acid ester include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. du Pont de Nemours and Co., Inc.), and Iotek 7510 and Iotek 7520 (both products of ExxonMobil Chemical).

Examples of the non-ionomer thermoplastic elastomer (B) used herein include olefin-based thermoplastic elastomers, styrene-based thermoplastic elastomers, polyester-based thermoplastic elastomers, polyurethane-based thermoplastic elastomers and polyamide-based thermoplastic elastomers. These may be used singly or as mixtures of two or more thereof. Of these, the use of an olefin-based thermoplastic elastomer is preferred for good compatibility with the ionomer resin.

The olefin-based thermoplastic elastomer is not critical so long as it is a thermoplastic elastomer composed primarily of an olefin. However, the use of an olefin-based thermoplastic elastomer having crystalline polyethylene blocks is preferred.

Suitable examples of crystalline polyethylene block-bearing olefin-based thermoplastic elastomers include those having hard segments composed of crystalline polyethylene blocks (E) or crystalline polyethylene blocks (E) in combination with crystalline polystyrene blocks (S), and having soft segments composed of a relatively random copolymer (EB) of ethylene and butylene. The use of a block copolymer having a molecular structure with a hard segment at one or both ends, such as an E-EB, E-EB-E or E-EB-S structure, is especially preferred.

These olefin-based thermoplastic elastomers can be prepared by the hydrogenation of a polybutadiene or a styrene-butadiene copolymer.

The polybutadiene or styrene-butadiene copolymer used in hydrogenation is preferably a polybutadiene in which the butadiene structure contains 1,4 polymer blocks which are 95 to 100% composed of 1,4 units, and the overall butadiene structure has a 1,4 unit content of 50 to 100 wt %, and most preferably 80 to 100 wt %. That is, the use of a polybutadiene having a 1,4 unit content of 50 to 100 wt %, and especially 80 to 100 wt %, and in which 95 to 100 wt % of the 1,4 units are included within blocks is preferred.

It is especially preferable for olefin-based thermoplastic elastomers having an E-EB-E structure to be prepared by the hydrogenation of a polybutadiene in which both ends of the molecular chain are 1,4 polymerization products rich in 1,4 units, and the center portion of which contains a mixture of 1,4 units and 1,2 units.

The degree of hydrogenation in the polybutadiene or styrene-butadiene copolymer hydrogenation product, expressed as the percent of double bonds in the polybutadiene or styrene-butadiene copolymer that are converted to saturated bonds, is preferably 60 to 100 wt %, and most preferably 90 to 100 wt %. Too low a degree of hydrogenation may lead to deterioration such as gelation in the blending step with the ionomer resin and other components. Moreover, the intermediate layer in the completed golf ball may have an inadequate durability to impact.

In the block copolymers having a molecular structure with a hard segment at one or both ends, such as an E-EB, E-EB-E or E-EB-S structure, which are preferable for use as the olefin-based thermoplastic elastomer, the hard segment content is preferably 10 to 50 wt %. A hard segment content which is too high may result in so low a flexibility as to keep the objects of the invention from being effectively achieved, whereas a hard segment content which is too low may lead to problems with molding of the blend.

The olefin-based thermoplastic elastomer described above has a melt index at 230° C. of preferably 0.01 to 15 g/10 min, and most preferably 0.03 to 10 g/10 min. Outside of this range, problems such as weld lines, sink marks and short shots may arise during injection molding.

The olefin-based thermoplastic elastomer preferably has a hardness of 50 to 95 (Shore A hardness). Too low a hardness may lower the durability of the golf ball to repeated shots, whereas too high a hardness may lower the resilience of blends with ionomer resin.

The olefin-based thermoplastic elastomer preferably has a number-average molecular weight of 30,000 to 800,000.

Commercial products are available as the crystalline polyethylene block-containing olefin-based thermoplastic elastomer described above. Suitable examples include Dynaron 6100P, HSB604 and 4600P (all products of JSR Corporation). The use of Dynaron 6100P is especially preferred herein because it is a block polymer having crystalline olefin blocks at both ends. These olefin-based thermoplastic elastomers may be used singly or as mixtures of two or more thereof.

To the non-ionomer thermoplastic elastomer (B) used herein, polar groups may be grafted so as to improve compatibility with the ionomer resin (A). Suitable, non-limiting examples of such polar groups include carboxyl groups, epoxy groups, hydroxyl groups and amino groups.

The non-ionomer thermoplastic elastomer (B) used herein has a Shore D hardness of generally 5 to 70, preferably 10 to 60, and more preferably 13 to 50. Too high a hardness may prevent a sufficient softening effect from being achieved, whereas too low a hardness may lower the flight performance.

In the practice of the invention, components (A) and (B) are used in a mixing ratio (A)/(B) of preferably 100/0 to 50/50 (weight ratio), more preferably 89/11 to 60/40 (weight ratio), and most preferably 85/15 to 65/35 (weight ratio). Too high a content of component (B) may make it impossible to improve the durability of the golf ball.

The intermediate layer used herein is formed of a thermoplastic resin composition, preferably comprising a thermoplastic resin as described above and an inorganic particulate filler.

The inorganic particulate filler used herein is, for example, barium sulfate, calcium carbonate or the like. In particular, the use of precipitated barium sulfate is preferred because of its advantage of imparting satisfactory durability regardless of the hardness distribution of the solid core.

In the intermediate layer, the inorganic particulate filler is included in an amount of generally 5 to 25 parts by weight, preferably 8 to 20 parts by weight, and more preferably 10 to 18 parts by weight, per 100 parts by weight of the thermoplastic resin. Too high a blend ratio of the inorganic particulate filler may diminish resilience, failing to provide sufficient flight distance. Too low a blend ratio of the inorganic particulate filler may exacerbate crack durability against repeated shots.

Preferably, the intermediate layer used herein may have blended therein a fatty acid or derivative thereof. Preferred examples of the fatty acid and derivative thereof include unsaturated fatty acids and derivatives thereof having a double bond or triple bond in the alkyl group, and saturated fatty acids and derivatives thereof in which all the bonds on the alkyl group are single bonds. It is recommended that the number of carbons on the molecule be at least 18, preferably at least 20, more preferably at least 22, and most preferably at least 24, but not more than 80, preferably not more than 60, more preferably not more than 40, and most preferably not more than 30. Too few carbons may result in a loss of heat resistance, and may also make the content of acid groups so high as to cause them to interact with acid groups present on the base resin, diminishing the flow-enhancing effect. On the other hand, too many carbons increases the molecular weight, which may also diminish the flow-enhancing effect.

Specific examples of the fatty acids include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Fatty acid derivatives include metallic soaps in which the proton on the acid group of the aforementioned fatty acid is substituted with a metal ion. Metal ions that may be used in such metallic soaps include $Na^{+}$, $Li^{+}$, $Ca^{2+}$, $Mg^{2+}$, $Zn^{2+}$, $M^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of the fatty acid derivatives include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferably used.

In the practice of the invention, the content of the fatty acid or derivative thereof relative to the content of the thermoplastic resin composed of components (A) and (B), expressed as (A+B)/(fatty acid or derivative), is from 100/5 to 100/80 (weight ratio), preferably from 100/10 to 100/40 (weight ratio), and more preferably from 100/15 to 100/25 (weight ratio). Too little fatty acid or derivative may lower the melt viscosity, reducing the workability of the composition, whereas too much may lower the durability.

The fatty acid or derivative thereof is preferably one having a molecular weight of from 280 to 1500. On account of a very low molecular weight as compared with components (A) and (B), such fatty acid or derivative thereof is effective for adjusting the melt viscosity of the mixture as appropriate and contributing to an improvement in flow.

The fatty acid or derivative thereof has a relatively high acid group (derivative) content, and can prevent an excessive loss of resilience. The fatty acid or derivative thereof has a molecular weight of generally at least 280, preferably at least 300, more preferably at least 330, and most preferably at least 360, but generally not more than 1,500, preferably not more than 1,000, more preferably not more than 600, and most preferably not more than 500. Too low a molecular weight may result in a loss of heat resistance, whereas too high a molecular weight may make it impossible to improve flow.

If necessary, various additives may be included in the intermediate layer material. Exemplary additives include pigments, dispersants, antioxidants, ultraviolet absorbers and light stabilizers.

According to the invention, the intermediate layer should have a specific gravity of 1.00 to 1.30 g/cm$^3$, preferably 1.03 to 1.20 g/cm$^3$, more preferably 1.05 to 1.18 g/cm$^3$. Too low a specific gravity may result in insufficient crack durability against repeated shots whereas too high a specific gravity may diminish resilience, resulting in decreased flight distance.

According to the invention, the intermediate layer is set to have a surface hardness (which refers to the surface hardness of a sphere consisting of the core enclosed with the intermediate layer, hereinafter) of at least 57, generally 57 to 73, preferably 58 to 68, and more preferably 59 to 64, as expressed in Shore D hardness units, or a surface hardness of 84 to 100, preferably 85 to 96, and more preferably 86 to 92, as expressed in JIS-C hardness units. At too low an intermediate layer surface hardness, the spin rate on W#1 shots may increase excessively and the rebound characteristics may decrease, resulting in a poor flight distance. On the other hand, an intermediate layer surface hardness that is too high may lower the crack durability against repeated shots and scuff resistance and exacerbate the feel upon impact in the short game and the feel upon impact with a putter.

According to the invention, the value obtained by subtracting the core surface hardness from the intermediate layer surface hardness, expressed in JIS-C hardness units, is set to be at least 0, typically 0 to 20, preferably 3 to 16, and more preferably 5 to 14. If the value obtained by subtracting the core surface hardness from the intermediate layer surface hardness is too small, the ball, on shots with a driver (W#1), may take on too much spin and follow a skying trajectory, resulting in a reduced distance. On the other hand, if the value obtained by subtracting the core surface hardness from the intermediate layer surface hardness is too large, crack durability against repeated shots may be exacerbated.

The intermediate layer generally has a gauge of 0.5 to 2.5 mm, preferably 0.8 to 1.5 mm, and more preferably 1.0 to 1.3 mm. If the intermediate layer is too thin, the crack durability against repeated shots may deteriorate or the spin rate gained on W#1 shots may increase too much, resulting in a reduced distance. Too great an intermediate layer gauge may exacerbate the feel on impact, especially with a putter, and scuff resistance.

The intermediate layer material should preferably have a melt flow rate adjusted to ensure particularly suitable flow characteristics for injection molding and thus improve moldability. Specifically, it is recommended that the melt flow rate (MFR), as measured according to JIS-K7210 at a temperature of 190° C. and under a load of 21.18 N (2.16 kgf), be set to generally at least 0.5 dg/min, preferably at least 1 dg/min, more preferably at least 1.5 dg/min, and even more preferably at least 2 dg/min, but generally not more than 20 dg/min, preferably not more than 10 dg/min, more preferably not more than 5 dg/min, and most preferably not more than 3 dg/min. Too high or low a melt flow rate may result in a marked decline in processability.

In the multi-piece solid golf ball of the invention, the outer layer may be formed of well-known polyurethane materials or rubber compositions preferably comprising at least 50 wt % of a polybutadiene containing at least 40 wt % cis-1,4 structure, although it is preferably formed of a polyurethane composition. The polyurethane composition is preferably one including (C) a thermoplastic polyurethane and (D) an isocyanate mixture.

The thermoplastic polyurethane (C) is not critical so long as it is a thermoplastic elastomer composed primarily of polyurethane. However, thermoplastic polyurethanes made up of polymeric polyols as the soft segments, and chain extenders and diisocyanates as the hard segments are preferred.

Any polymeric polyol employed in the prior art relating to thermoplastic polyurethane materials may be used without particular limitation. Examples include polyester polyols, polyether polyols, copolyester polyols and polycarbonate polyols, any of which may be used with good results. Of these, polyether polyols are preferred for the preparation of thermoplastic polyurethanes having excellent impact resilience and low-temperature properties, and polyester polyols are preferred for their heat resistance and broad molecular design capabilities.

Illustrative examples of polyester polyols include polycaprolactone glycol, poly(ethylene 1,4-adipate) glycol and poly(butylene 1,4-adipate) glycol.

Suitable examples of polyether polyols include polytetramethylene glycol and polypropylene glycol. Polytetramethylene glycol is preferred.

Exemplary of the copolyester polyol is poly(diethylene glycol adipate) glycol.

Exemplary of the polycarbonate polyol is (hexanediol-1, 6-carbonate) glycol.

These polymeric polyols generally have a number-average molecular weight of at least 500, preferably at least 1,000, and most preferably at least 2,000, but not more than 5,000, preferably not more than 4,000, and most preferably not more than 3,000.

Any diisocyanate employed in the prior art relating to thermoplastic polyurethane materials may be used without particular limitation. Illustrative examples include 4,4'-diphenylmethane diisocyanate, 2,4-toluene diisocyanate, 2,6-toluene diisocyanate, hexamethylene diusocyanate, 2,2, 4- and 2,4,4-trimethylhexamethylene diisocyanate, lysine diisocyanate and tolylene diisocyanate.

However, some isocyanate compounds can make it difficult to control the crosslinking reaction during injection molding. In the practice of the invention, the use of 4,4'-diphenylmethane diisocyanate is preferred for good compatibility with the isocyanate mixture to be described later.

Any chain extender employed in the prior art relating to thermoplastic polyurethane materials may be used without particular limitation. For instance, use may be made of any ordinary polyhydric alcohol or amine. Specific examples include 1,4-butylene glycol, 1,2-ethylene glycol, 1,3-butanediol, 1,6-hexanediol, 2,2-dimethyl-1,3-propanediol, dicyclohexylmethylmethanediamine (hydrogenated MDI) and isophoronediamine (IPDA).

These chain extenders generally have a number-average molecular weight of at least 20, but not more than 15,000.

No limitation is imposed on the specific gravity of the thermoplastic polyurethane, so long as it is suitably controlled within a range that allows the objects of the invention to be achieved. The specific gravity is preferably from 1.0 to 1.3, and most preferably from 1.1 to 1.25.

The above-described thermoplastic polyurethane used herein may be a commercial product. Illustrative examples include Pandex T8290, T8295 and T8260 (all manufactured by DIC Bayer Polymer, Ltd.), and Resamine 2593 and 2597 (manufactured by Dainichi Seika Colour & Chemicals Mfg. Co., Ltd.).

The isocyanate mixture (D) is preferably one prepared by dispersing (d-1) a compound having as functional groups at least two isocyanate groups per molecule in (d-2) a thermoplastic resin that is substantially non-reactive with isocyanate.

The compound having as functional groups at least two isocyanate groups per molecule which serves as component (d-1) may be an isocyanate compound used in the prior art relating to polyurethanes, such as an aromatic isocyanate compound, a hydrogenated aromatic isocyanate compound, an aliphatic diisocyanate or an alicyclic diisocyanate.

Suitable examples of aromatic isocyanate compounds include 2,4-toluene diusocyanate, 2,6-toluene diisocyanate, mixtures of 2,4-toluene diisocyanate with 2,6-toluene diusocyanate, 4,4'-diphenylmethane diisocyanate, m-phenylene diusocyanate and 4,4'-diphenyl diisocyanate.

Suitable examples of hydrogenated aromatic isocyanate compounds include dicyclohexylmethane diisocyanate.

Suitable examples of aliphatic diisocyanates include tetramethylene diisocyanate, hexamethylene diisocyanate and octamethylene diisocyanate.

Suitable examples of alicyclic diisocyanates include isophorone diisocyanate.

To assure good reactivity and work safety, the use of 4,4'-diphenylmethane diisocyanate is preferred.

The thermoplastic resin (d-2) that is substantially non-reactive with isocyanate is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester thermoplastic elastomers (e.g., polyether-ester block copolymers, polyester-ester block copolymers).

For good impact resilience and strength, the use of a polyester thermoplastic elastomer is especially preferred. The polyester thermoplastic elastomer is not critical, provided it is a thermoplastic elastomer composed primarily of polyester. The use of a polyester-based block copolymer composed primarily of high-melting crystalline polymer segments made of crystalline aromatic polyester units and low-melting polymer segments made of aliphatic polyether units and/or aliphatic polyester units is preferred.

Preferred examples of the high-melting crystalline polymer segments made of crystalline aromatic polyester units include polybutylene terephthalate derived from terephthalic acid and/or dimethyl terephthalate in combination with 1,4-butanediol. Other suitable, non-limiting, examples include polyesters derived from a dicarboxylic acid component such as isophthalic acid, phthalic acid, naphthalene-2, 6-dicarboxylic acid, naphthalene-2,7-dicarboxylic acid, diphenyl-4,4'-dicarboxylic acid, diphenoxyethanedicarboxylic acid, 5-sulfoisophthalic acid or an ester-forming derivative thereof in combination with a diol having a molecular weight of up to 300, such as an aliphatic diol (e.g., ethylene glycol, trimethylene glycol, pentamethylene glycol, hexamethylene glycol, neopentyl glycol, decamethylene glycol), an alicyclic diol (e.g., 1,4-cyclohexanedimethanol, tricyclodecanedimethylol), or an aromatic diol (e.g., xylylene glycol, bis(p-hydroxy)

diphenyl, bis(p-hydroxy-phenyl)propane, 2,2-bis[4-(2-hydroxyethoxy)phenyl]propane, bis[4-(2-hydroxy)phenyl] sulfone, 1,1-bis[4-(2-hydroxy-ethoxy)phenyl]cyclohexane, 4,4'-dihydroxy-p-terphenyl and 4,4'-dihydroxy-p-quarterphenyl). Use can also be made of any copolymeric polyester obtained using two or more of these dicarboxylic acid components and diol components.

In addition, polycarboxylic acid components, polyoxy components and polyhydroxy components having a functionality of three or more can be copolymerized therein within a range of up to 5 mol %.

In the low-melting polymer segments made of aliphatic polyether units and/or aliphatic polyester units, illustrative examples of the aliphatic polyether include poly(ethylene oxide) glycol, poly(propylene oxide) glycol, poly (tetramethylene oxide) glycol, poly(hexamethylene oxide) glycol, copolymers of ethylene oxide and propylene oxide, ethylene oxide addition polymers of poly(propylene oxide) glycols, and copolymers of ethylene oxide and tetrahydrofuran. Illustrative examples of the aliphatic polyester include poly(ε-caprolactone), polyenantholactone, polycaprylolactone, poly(butylene adipate) and poly (ethylene adipate).

The low-melting polymer segments have a number-average molecular weight in the copolymerized state of preferably about 300 to 6,000.

In cases where the polyester thermoplastic elastomer used is one composed primarily of high-melting crystalline polymer segments made of crystalline aromatic polyester units and low-melting polymer segments made of aliphatic polyether units and/or aliphatic polyester units, it is advantageous to adjust the amount of low-melting polymer segments made of aliphatic polyether units and/or aliphatic polyester units copolymerized relative to the amount of high-melting crystalline polymer segment made of crystalline aromatic polyester units to at least 15 wt %, and preferably at least 50 wt %, but not more than 90 wt %. If the proportion of low-melting polymer segments made of aliphatic polyether units and/or aliphatic polyester units is too high, adequate melt characteristics may not be obtained in the thermoplastic copolymer, which can make it difficult to achieve uniform mixture during melt blending with the other components. On the other hand, if the proportion is too low, sufficient flexibility and resilience may not be achieved.

Examples of polyester thermoplastic elastomers preferred for use in the invention include those in the Hytrel series made by DuPont-Toray Co., Ltd., and those in the Primalloy series made by Mitsubishi Chemical Corporation.

When the isocyanate mixture (D) is prepared, it is desirable for the relative proportions of above components (d-1) and (d-2), expressed as (d-1)/(d-2), to be within a range of 100/5 to 100/100 (weight ratio), and especially 100/10 to 100/40 (weight ratio). If the amount of component (d-1) relative to component (d-2) is too small, more isocyanate mixture (D) must be added to achieve sufficient addition for the crosslinking reaction with the thermoplastic polyurethane (C). In such cases, component (d-2) exerts a larger effect, which may render inadequate the physical properties of the thermoplastic polyurethane composition serving as the cover stock. If the amount of component (d-1) is too large, component (d-1) may cause slippage to occur during mixing, making it difficult to prepare the thermoplastic polyurethane composition that serves as the cover material.

The isocyanate mixture (D) can be prepared by blending component (d-1) into component (d-2) and thoroughly working together these components at a temperature of 130 to 250° C. using mixing rollers or a Banbury mixer, then carrying out pelletization or cooling, followed by grinding.

The isocyanate mixture (D) may be a commercial product. Preferred examples include Crossnate EM30 (made by Dainichi Seika Colour & Chemicals Mfg. Co., Ltd.) and Pandex AC-Master (made by DIC Bayer Polymer, Ltd.).

Above component (D) is generally included in an amount, per 100 parts by weight of component (C), of at least 1 part by weight, preferably at least 5 parts by weight, and most preferably at least 10 parts by weight, but not more than 100 parts by weight, preferably not more than 50 parts by weight, and most preferably not more than 30 parts by weight. Too little component (D) may make it impossible to achieve a sufficient crosslinking reaction, thus preventing enhancement of physical properties. On the other hand, too much may result in greater discoloration over time or due to the effects of heat and ultraviolet light, and may also have other undesirable effects, such as lowering resilience.

In addition to the components (C) and (D) described above, the polyurethane composition may include also other resin components. Illustrative examples of such additional resin components include polymeric thermoplastic materials other than thermoplastic polyurethane, such as polyester elastomers, polyamide elastomers, ionomer resins, styrene block elastomers, polyethylenes and nylons.

The above polymeric thermoplastic materials other than thermoplastic polyurethane are typically included in an amount, per 100 parts by weight of the thermoplastic polyurethane serving as the essential component, of at least 0 part by weight, preferably at least 5 parts by weight, and most preferably at least 10 parts by weight, but not more than 100 parts by weight, preferably not more than 75 parts by weight, and most preferably not more than 50 parts by weight. These polymeric thermoplastic materials other than polyurethane are selected as appropriate for such purposes as adjusting the hardness of the cover and improving resilience, flow and adhesion.

If necessary, the polyurethane composition of the invention may also include various additives. Examples of such additives include pigments, dispersants, antioxidants, ultraviolet absorbers, ultraviolet stabilizers, parting agents, plasticizers and inorganic fillers (e.g., zinc oxide, barium sulfate, titanium dioxide).

When such additives are included, the amount of addition may be selected from within ranges that do not compromise the objects of the invention. Typically, such additives are included in an amount, per 100 parts by weight of the thermoplastic polyurethane (C), of preferably at least 0.1 part by weight, and most preferably at least 0.5 part by weight, but not more than 10 parts by weight, and most preferably not more than 5 parts by weight.

In the practice of the invention, the cover may be molded from the above polyurethane composition, for example, by adding component (D) to component (C) and dry mixing. Using an injection molding machine, the mixture is molded over the intermediate layer enclosing the core to form a cover therearound. Molding is generally carried out within a temperature range of 150 to 250° C., although the molding temperature will depend on the type of component (D).

Reactions and crosslinking which take place in the cover thus obtained are believed to involve the reaction of isocyanate groups with hydroxyl groups remaining on the thermoplastic polyurethane material to form urethane bonds, or the formation of an allophanate or biuret crosslinked form via an addition reaction in which isocyanate groups are added to the urethane groups on the thermoplastic polyurethane. Although the crosslinking reaction has not yet proceeded to a sufficient degree immediately subsequent to injection molding of the thermoplastic polyurethane composition used as the cover stock, the crosslinking reaction can be made to proceed further by carrying out an annealing step after molding, in this way conferring the golf ball with useful cover characteristics. "Annealing," as used herein, refers to heat aging the cover at a certain temperature for a predetermined length of time, or aging the cover for a predetermined period at room temperature.

According to the invention, the outer layer should have a specific gravity of at least 1.00 g/cm$^3$, typically 1.00 to 1.30 g/cm$^3$, preferably 1.05 to 1.25 g/cm$^3$, more preferably 1.08 to 1.20 g/cm$^3$. A specific gravity below 1.00 g/cm$^3$ necessitates the use of an ionomer resin, sometimes failing to provide sufficient scuff resistance. On the other hand, a specific gravity above 1.30 g/cm$^3$ requires too large an amount of filler, which may diminish resilience, failing to provide sufficient distance.

The surface hardness of the outer layer used herein, expressed in Shore D hardness units, is at least 51, preferably at least 53, and most preferably at least 55, but generally not more than 66, preferably not more than 64, and more preferably not more than 62. Too low an outer layer surface hardness may make the ball overly receptive to spin, failing to allow for appropriate rolling, or may cause to ball to gain a too much spin rate on W#1 shots, failing to provide sufficient distance. On the other hand, too high an outer layer surface hardness may cause the spin rate on approach shots to decline, leading to poor controllability, may lower the durability to cracking with repeated impact and the scuff resistance, and may worsen the feel of the ball upon impact in the "short game" or when hit with a putter.

It is noted that the outer layer typically has a gauge of 0.5 to 1.8 mm, preferably 0.7 to 1.5 mm, and more preferably 0.9 to 1.2 mm. If the outer layer is too thin, there may result insufficient controllability, poor scuff resistance, poor crack durability against repeated shots, and too hard a feel on impact with a putter. On the other hand, too great an outer layer gauge may diminish resilience, failing to provide distance.

If bonding between the intermediate layer and the outer layer is poor, an adhesive may be used therebetween in order to provide a better durability to impact. The adhesive used herein is not critical although it is preferably selected from chlorinated polyolefin adhesives, urethane resin adhesives, epoxy resin adhesives, vinyl resin adhesives and rubber adhesives.

Commercial products are available as the adhesive. An exemplary chlorinated polyolefin adhesive is RB182 Primer (made by Nippon Bee Chemical Co., Ltd.) and an exemplary urethane resin adhesive is Resamine D6208 (made by Dainichi Seika Colour & Chemicals Mfg. Co., Ltd.).

It is not critical how to use the adhesive layer. An adhesive layer typically having a thickness of 0.1 to 30 $\mu$m may be formed between the intermediate layer and the outer layer. It is also acceptable to use the adhesive on only part of the intermediate layer surface.

According to the invention, the intermediate layer and the outer layer are set to have a total gauge of up to 3.3 mm, preferably 1.0 to 3.0 mm, more preferably 1.4 to 2.7 mm, and more preferably 1.6 to 2.5 mm. If the total gauge of the intermediate layer and the outer layer is too much, the volume of the core must be reduced so that resilience may be diminished, failing to provide flight distance. If the total gauge of the intermediate layer and the outer layer is too less, the durability to cracking by repeated shots may become poor.

According to the invention, the surface hardness of the intermediate layer is set higher than the surface hardness of the outer layer. The value obtained by subtracting the intermediate layer surface hardness from the outer layer surface hardness, as expressed in Shore D hardness units, is typically from −18 to less than 0, preferably from −15 to −2, and more preferably from −12 to −4. If the value obtained by subtracting the intermediate layer surface hardness from the outer layer surface hardness is too small in magnitude, there may result poor scuff resistance or poor durability to cracking by repeated shots. If the value is too large in magnitude, there may result poor controllability or a poor feel on impact with a putter.

Dimples may be formed as desired on the surface of the multi-piece solid golf ball of the invention. The "dimple volume occupancy," abbreviated below as VR and expressed in units of percent, is defined as the ratio of the volume of dimples on the golf ball surface to the volume of a hypothetical golf ball without dimples. For shots taken with a driver (W#1), it is desirable for the multi-piece solid golf ball of the invention to have a VR value of at least 0.66, preferably at least 0.70, and most preferably at least 0.75, but not more than 1.00, preferably not more than 0.95, and most preferably not more than 0.85. At too low a VR value, the ball tends to follow a skying arc and does not roll well on landing, resulting in a short total distance. On the other hand, at too high a VR value, the ball tends to have a less rising trajectory and thus a poor carry, resulting in a short total distance.

It is advantageous for the multi-piece solid golf ball of the invention to be manufactured so as to have an initial velocity of at least 76.4 m/s, preferably at least 76.6 m/s, and most preferably at least 76.8 m/s, but not more than 77.7 m/s. Too low an initial velocity may result in a short flight distance, whereas too high an initial velocity causes the golf ball to fall outside the specifications set by the Royal and Ancient Golf Club of St. Andrews (R&A) and the United States Golf Association (USGA).

"Initial velocity," as used herein, is a value measured using an initial velocity measuring apparatus of the same type as the USGA drum rotation-type initial velocity instrument approved by the R&A. The ball was temperature conditioned at 23±1° C. for at least 3 hours, and tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.88 m) was measured and used to compute the initial velocity. This cycle was carried out over a period of about 15 minutes.

EXAMPLE

Examples of the invention and comparative examples are given below by way of illustration and not be way of limitation.

Examples 1–3 & Comparative Examples 1–10

Golf ball cores were produced by a conventional method using the core formulations shown in Table 1 wherein all component amounts are in parts by weight. Table 1 also gives the physical properties of these cores.

TABLE 1

| Components | | | Example | | | Comparative Example | | | | | | | | | |
|---|---|---|---|---|---|---|---|---|---|---|---|---|---|---|---|
| (parts by weight) | | | 1 | 2 | 3 | 1 | 2 | 3 | 4 | 5 | 6 | 7 | 8 | 9 | 10 |
| Polybutadiene | | | 100 | 100 | 100 | 100 | 100 | 100 | 100 | 100 | 100 | 100 | 100 | 100 | 100 |
| Zinc acrylate | | | 37.3 | 34.4 | 34.4 | 37.3 | 37.3 | 34.4 | 34.4 | 37.3 | 34.4 | 33.6 | 44.5 | 34.4 | 32.0 |
| Zinc oxide | | | 6.3 | 7.6 | 7.6 | 5.0 | 13.3 | 12.8 | 5.0 | 5.0 | 7.2 | 8.5 | 5.0 | 6.8 | 9.2 |
| Organic peroxide (1) | | | 0.6 | 0.6 | 0.6 | 0.6 | 0.6 | 0.6 | 0.6 | 0.6 | 0.6 | 0.5 | 0.6 | 0.6 | 0.6 |
| Organic peroxide (2) | | | 0.8 | 0.8 | 0.8 | 0.8 | 0.8 | 0.8 | 0.8 | 0.8 | 0.8 | 0.5 | 0.8 | 0.8 | 0.6 |
| Organosulfur compound (4) | | | 1 | 1 | 1 | 1 | 1 | 1 | 1 | 1 | 1 | 1 | 1 | 1 | 1 |
| Antioxidant | | | 0 | 0 | 0 | 0 | 0 | 0 | 0 | 0 | 0 | 0.2 | 0 | 0 | 0.2 |
| Sulfur (3) | | | 0.1 | 0.1 | 0.1 | 0.1 | 0.1 | 0.1 | 0.1 | 0.1 | 0.1 | 0 | 0.1 | 0.1 | 0 |
| Vulcanization method | 1st stage | | X | X | X | X | X | X | X | X | X | Y | X | X | X |
| | 2nd stage | | — | — | — | — | — | — | — | — | — | Z | — | — | — |
| Core properties | Outside diameter (mm) | | 38.00 | 38.50 | 38.50 | 38.00 | 38.00 | 38.50 | 38.50 | 38.00 | 35.90 | 38.00 | 38.00 | 38.50 | 38.50 |
| | Weight (g) | | 31.8 | 33.1 | 33.1 | 31.6 | 32.9 | 34.0 | 31.9 | 31.5 | 27.0 | 31.8 | 32.1 | 32.9 | 33.1 |
| | Specific gravity (g/cm$^3$) | | 1.11 | 1.11 | 1.11 | 1.10 | 1.15 | 1.14 | 1.07 | 1.10 | 1.11 | 1.11 | 1.12 | 1.10 | 1.11 |
| | Hardness | Core surface (5) | 84 | 82 | 82 | 84 | 84 | 82 | 82 | 84 | 82 | 74 | 94 | 82 | 80 |
| | | Core center (6) | 61 | 60 | 60 | 61 | 61 | 60 | 60 | 61 | 60 | 69 | 69 | 60 | 66 |
| | | (5) − (6) | 23 | 22 | 22 | 23 | 23 | 22 | 22 | 23 | 22 | 5 | 25 | 22 | 14 |
| | | Core average | 73 | 71 | 71 | 73 | 73 | 71 | 71 | 73 | 71 | 72 | 82 | 71 | 73 |

Polybutadiene: trade name BR01, made by JSR Corporation.

Organic Peroxide (1): trade name Percumil D, made by NOF Corporation. Dicumyl peroxide.

Organic Peroxide (2): trade name Perhexa 3M-40, made by NOF Corporation. 1,1-Bis(t-butylperoxy)-3,3,5-trimethylcyclo-hexane.

Sulfur (3): trade name Zinc White/Sulfur Mix (95% sulfur), made by Tsurumi Chemical Industry Co., Ltd.

Organosulfur Compound (4): Zinc pentachlorothiophenol.

Antioxidant: trade name Nocrac NS-6, made by Ouchi Shinko Chemical Industry Co., Ltd.

Zinc oxide: trade name Type 3 Zinc Oxide, made by Sakai Chemical Industry Co., Ltd.

Vulcanization method

X: 175° C.×15 min

Y: 145° C.×30 min

Z: 170° C.×10 min

Hardness/core Surface (5)

The hardness on a spherical surface of the core was measured in accordance with the C-scale hardness measurement method prescribed by JIS K6301-1975, and expressed in JIS-C hardness units.

Hardness/core Center (6)

The hardness at the center of a hemisphere obtained by cutting the core was measured in accordance with the C-scale hardness measurement method prescribed by JIS K6301-1975, and expressed in JIS-C hardness units.

Hardness/(5)–(6)

The value obtained by subtracting the core center hardness (6), expressed in JIS-C hardness units, from the core surface hardness (5), expressed in JIS-C hardness units.

Hardness/core Average

The arithmetic mean of the core surface hardness (5), expressed in JIS-C hardness units, and the core center hardness (6), expressed in JIS-C hardness units.

Intermediate layer-covered cores were obtained by placing a core in a mold and injection molding therein intermediate layer materials of the compositions shown in Table 2 wherein all component amounts are in parts by weight. Table 2 also gives the physical properties of the resulting intermediate layer-covered cores A.

TABLE 2

| Components | Example | | | Comparative Example | | | | | | | | | |
|---|---|---|---|---|---|---|---|---|---|---|---|---|---|
| (parts by weight) | 1 | 2 | 3 | 1 | 2 | 3 | 4 | 5 | 6 | 7 | 8 | 9 | 10 |
| Himilan 1605 | 65.0 | 65.0 | 65.0 | | | 52.9 | 65.0 | | 65.0 | | | 50.0 | |
| Himilan 1706 | | | | | | | | | | | | 50.0 | |
| Himilan 1601 | | | | | | | | | | | | | |
| Himilan 1557 | | | | | | | | | | | | | |
| Himilan 1650 | | | | | 50.0 | | | | | 50.0 | 50.0 | | |
| Surlyn 8120 | | | | | 50.0 | | | | | 50.0 | 50.0 | | |
| Hytrel 4767 | | | | 100.0 | | | | | | | | | |
| Hytrel 5557 | | | | | | | | 100.0 | | | | | 100.0 |
| Dynaron 6100P | 35.0 | 35.0 | 35.0 | | | 28.5 | 30.0 | | 35.0 | | | | |
| Barium sulfate 300 | 15.0 | 15.0 | 15.0 | | 15.0 | | 35.0 | | 15.0 | 15.0 | 15.0 | 15.0 | |

TABLE 2-continued

| Components (parts by weight) | | Example 1 | Example 2 | Example 3 | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|---|---|---|---|
| Behenic acid | | 22.0 | 22.0 | 22.0 | | | 17.9 | 22.0 | | 22.0 | | | 20.0 | |
| Calcium hydroxide | | 2.7 | 2.7 | 2.7 | | | 2.2 | 2.7 | | 2.7 | | | 2.8 | |
| Intermediate layer/ intermediate layer-covered core properties | Specific gravity ($g/cm^3$) | 1.11 | 1.11 | 1.11 | 1.15 | 1.10 | 0.94 | 1.41 | 1.19 | 1.11 | 1.10 | 1.10 | 1.11 | 1.19 |
| | Weight (g) | 38.2 | 39.1 | 38.5 | 38.2 | 39.3 | 39.1 | 38.8 | 38.4 | 35.7 | 38.2 | 38.5 | 36.9 | 38.6 |
| | Surface hardness (7) | 63 | 63 | 63 | 52 | 62 | 65 | 64 | 60 | 63 | 62 | 62 | 69 | 60 |
| | Surface hardness (8) | 91 | 91 | 91 | 79 | 90 | 93 | 92 | 88 | 91 | 90 | 90 | 97 | 88 |
| | Outside diameter (mm) | 40.40 | 40.70 | 40.50 | 40.40 | 40.40 | 40.70 | 40.50 | 40.40 | 39.45 | 40.40 | 40.40 | 40.00 | 40.40 |
| | Intermediate layer gauge (mm) | 1.20 | 1.10 | 1.00 | 1.20 | 1.20 | 1.10 | 1.00 | 1.20 | 1.78 | 1.20 | 1.20 | 0.75 | 0.95 |

Himilan 1605, Himilan 1706, Himilan 1601, Himilan 1557, Himilan 1650; ionomer resins made by DuPont-Mitsui Polychemicals Co., Ltd.

Surlyn 8120; ionomer resin made by DuPont Hytrel 4767, Hytrel 5557; polyester elastomers made by DuPont-Toray Co., Ltd.

Dynaron 6100P: olefin-based thermoplastic elastomer made by JSR Corporation.

Barium sulfate 300; precipitated barium sulfate made by Sakai Chemical Co., Ltd.

Behenic Acid: trade name NAA222-S (beads), made by NOF Corporation.

Calcium Hydroxide: trade name CLS-B, made by Shiraishi Kogyo Kaisha, Ltd.

Intermediate Layer/intermediate Layer-covered Core Properties/specific Gravity ($g/cm^3$)

Specific gravity ($g/cm^3$) of the intermediate layer

Intermediate Layer/intermediate Layer-covered Core Properties/weight (g)

Weight (g) of intermediate layer-covered core

Intermediate Layer/intermediate Layer-covered Core Properties/surface Hardness (7)

The hardness at a surface of a sphere consisting of the core enclosed with the intermediate layer was measured in accordance with ASTM D-2240 and expressed in Shore D hardness units.

Intermediate Layer/intermediate Layer-covered Core Properties/surface Hardness (8)

The hardness at a surface of a sphere consisting of the core enclosed with the intermediate layer was measured in accordance with the C-scale hardness measurement method prescribed by JIS K6301-1975 and expressed in JIS-C hardness units.

Intermediate Layer/intermediate Layer-covered Core Properties/outside Diameter (mm)

Outside diameter (mm) of a sphere consisting of the core enclosed with the intermediate layer Intermediate Layer/intermediate Layer-covered Core Properties/intermediate Layer Gauge (mm)

The value obtained by subtracting the core outside diameter (mm) from the outside diameter (mm) of a sphere consisting of the core enclosed with the intermediate layer and dividing the difference by 2.

Three-piece solid golf balls were manufactured by injection molding cover stock of the composition shown in Table 3 (wherein all component amounts are in parts by weight) over the intermediate layer described above. Dimples were formed on the surface (VR=0.78). Table 3 also gives the physical properties of the three-piece solid golf balls.

TABLE 3

| Components (parts by weight) | | Example 1 | Example 2 | Example 3 | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|---|---|---|---|
| Adhesive to intermediate layer | Used or not | Yes | Yes | Yes | Yes | No | Yes | Yes | Yes | Yes | Yes | Yes | Yes | Yes |
| Pandex T8295 | | 100.0 | 100.0 | 50.0 | | | 100.0 | 100.0 | | 100.0 | 100.0 | 100.0 | | 100.0 |
| Pandex T8260 | | | | 50.0 | 100.0 | | | | 100.0 | | | | | |
| Pandex T7298 | | | | | | | | | | | | | 50.0 | |
| Pandex TR3080 | | | | | | | | | | | | | 50.0 | |
| Himilan 1855 | | | | | | 35.0 | | | | | | | | |
| Surlyn 8120 | | | | | | 35.0 | | | | | | | | |
| AN4311 | | | | | | 30.0 | | | | | | | | |
| Titanium dioxide | | 4.0 | 4.0 | 4.0 | 4.0 | 4.0 | 4.0 | 4.0 | 4.0 | 4.0 | 4.0 | 4.0 | 4.0 | 4.0 |
| Polyethylene wax | | 1.5 | 1.5 | 1.5 | 1.5 | | 1.5 | 1.5 | 1.5 | 1.5 | 1.5 | 1.5 | 1.5 | 1.5 |
| Isocyanate compound (9) | | 10.0 | 10.0 | 10.0 | 10.0 | | 10.0 | 10.0 | 10.0 | 10.0 | 10.0 | 10.0 | | 10.0 |
| Isocyanate compound (10) | | | | | | | | | | | | | 1.5 | |
| Outer layer/ outer layer-covered | Specific gravity ($g/cm^3$) | 1.13 | 1.13 | 1.13 | 1.14 | 0.96 | 1.13 | 1.13 | 1.14 | 1.13 | 1.13 | 1.13 | 1.15 | 1.13 |

TABLE 3-continued

| Components (parts by weight) | | Example 1 | Example 2 | Example 3 | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|---|---|---|---|
| sphere properties | Weight (g) | 45.4 | 45.4 | 45.4 | 45.5 | 45.4 | 45.4 | 45.7 | 45.7 | 45.6 | 45.4 | 45.7 | 45.4 | 45.8 |
| | Surface hardness (11) | 56 | 56 | 59 | 63 | 53 | 56 | 56 | 63 | 56 | 56 | 56 | 50 | 50 |
| | Outside diameter (mm) | 42.70 | 42.70 | 42.70 | 42.70 | 42.70 | 42.70 | 42.70 | 42.70 | 42.70 | 42.70 | 42.70 | 42.70 | 42.70 |
| | Outer layer gauge (mm) | 1.15 | 1.00 | 1.10 | 1.15 | 1.15 | 1.00 | 1.10 | 1.15 | 1.63 | 1.15 | 1.15 | 1.35 | 1.15 |

Adhesive: trade name RB-182 Primer, made by Nippon Bee Chemical Co., Ltd., chlorinated polyolefin Pandex T8295, Pandex T8260, Pandex T7298, Pandex TR3080; thermoplastic polyurethanes made by DIC Bayer Polymer, Ltd.

Himilan 1855; ionomer resin made by DuPont-Mitsui Polychemicals Co., Ltd.

Surlyn 8120; ionomer resin made by DuPont

AN4311; Nucrel made by DuPont-Mitsui Polychemicals Co., Ltd.

Isocyanate Compound (9): trade name Crossnate EM30, made by Dainichi Seika Colour & Chemicals Mfg. Co., Ltd. Contains 30% 4,4'-diphenylmethane diisocyanate (isocyanate concentration as determined by amine back titration according to JIS K1556: 5 to 10%). The master batch base resin was a polyester elastomer. On use, this isocyanate compound was mixed just prior to injection molding.

Isocyanate Compound (10): trade name Desmodur W, made by ACI Japan Co., Ltd. hydrogenated MDI. dicyclohexylmethane-4,4'-diisocyanate. On use, this isocyanate compound was mixed by previously milling in an extruder.

Outer Layer/outer Layer-covered Sphere Properties/specific Gravity (g/cm$^3$)

Specific gravity (g/cm$^3$) of the outer layer

Outer Layer/outer Layer-covered Sphere Properties/weight (g)

Weight (g) of outer layer-covered sphere

Outer Layer/outer Layer-covered Sphere Properties/surface Hardness (11)

The hardness at a land surface of a ball consisting of the intermediate layer enclosed with the outer layer was measured in accordance with ASTM D-2240 and expressed in Shore D hardness units.

Outer Layer/outer Layer-covered Sphere Properties/outside Diameter (mm)

Outside diameter (mm) of a ball consisting of the intermediate layer enclosed with the outer layer Outer Layer/outer Layer-covered Sphere Properties/outer Layer Gauge (mm)

The value obtained by subtracting the outside diameter (mm) of the intermediate layer-covered sphere from the outside diameter (mm) of a ball consisting of the intermediate layer enclosed with the outer layer and dividing the difference by 2.

The properties of the core, intermediate layer and outer layer of each golf ball are shown in Table 4 together with the results of performance tests of the golf balls.

TABLE 4

| | | Example 1 | Example 2 | Example 3 | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|---|---|---|---|
| Type | Intermediate layer | I | I | I | E | I | I | I | E | I | I | I | I | E |
| | Outer layer | U | U | U | U | I | U | U | U | U | U | U | U | U |
| Total gauge (mm) | | 2.35 | 2.10 | 2.10 | 2.35 | 2.35 | 2.10 | 2.10 | 2.35 | 3.40 | 2.35 | 2.35 | 2.10 | 2.10 |
| Hardness | (5) | 84 | 82 | 82 | 84 | 84 | 82 | 82 | 84 | 82 | 74 | 94 | 82 | 80 |
| | (6) | 61 | 60 | 60 | 61 | 61 | 60 | 60 | 61 | 60 | 69 | 69 | 60 | 66 |
| | (7) | 63 | 63 | 63 | 52 | 62 | 65 | 64 | 60 | 63 | 62 | 62 | 69 | 60 |
| | (8) | 91 | 91 | 91 | 79 | 90 | 93 | 92 | 88 | 91 | 90 | 90 | 97 | 88 |
| | (11) | 56 | 56 | 59 | 63 | 53 | 56 | 56 | 63 | 56 | 56 | 56 | 50 | 50 |
| Specific gravity | Intermediate layer (g/cm$^3$) | 1.11 | 1.11 | 1.11 | 1.15 | 1.10 | 0.94 | 1.41 | 1.19 | 1.11 | 1.10 | 1.10 | 1.11 | 1.19 |
| | Outer layer (g/cm$^3$) | 1.13 | 1.13 | 1.13 | 1.14 | 0.96 | 1.13 | 1.13 | 1.14 | 1.13 | 1.13 | 1.13 | 1.15 | 1.13 |
| Hardness difference | (11) − (7) | −7 | −7 | −4 | 11 | −9 | −9 | −8 | 3 | −7 | −6 | −6 | −19 | −10 |
| | (5) − (6) | 23 | 22 | 22 | 23 | 23 | 22 | 22 | 23 | 22 | 5 | 25 | 22 | 14 |
| | (8) − (5) | 7 | 9 | 9 | −5 | 6 | 11 | 10 | 4 | 9 | 16 | −4 | 15 | 8 |
| Golf ball | Flight charac- Spin (rpm) | 3053 | 2971 | 2939 | 2975 | 3087 | 2971 | 2953 | 2978 | 2977 | 3243 | 3294 | 3040 | 3224 |

TABLE 4-continued

| | | | Example | | | Comparative Example | | | | | | | | | |
|---|---|---|---|---|---|---|---|---|---|---|---|---|---|---|---|
| | | | 1 | 2 | 3 | 1 | 2 | 3 | 4 | 5 | 6 | 7 | 8 | 9 | 10 |
| per-for-mance | teristics | Carry (m) | 191.4 | 191.0 | 190.7 | 191.0 | 191.5 | 192.2 | 189.0 | 189.9 | 187.9 | 191.0 | 191.1 | 192.1 | 191.0 |
| | | Total (m) | 202.9 | 203.2 | 204.3 | 200.5 | 202.7 | 204.2 | 198.8 | 201.2 | 199.5 | 199.0 | 198.6 | 205.7 | 199.8 |
| | | Rat-ing | ○ | ○ | ○ | ○ | ○ | ○ | X | ○ | X | X | X | ○ | X |
| | Control charac-teristics | Spin (rpm) | 6210 | 6127 | 5932 | 5837 | 6284 | 6112 | 6119 | 5778 | 6127 | 6217 | 6468 | 6472 | 6677 |
| | | Rat-ing | ○ | ○ | ○ | X | ○ | ○ | ○ | X | ○ | ○ | ○ | ○ | ○ |
| | Feel | W#1 | ○ | ○ | ○ | ○ | ○ | ○ | ○ | ○ | ○ | X | X | ○ | Δ |
| | | Putter | ○ | ○ | ○ | X | ○ | ○ | ○ | X | ○ | ○ | X | ○ | ○ |
| | Impact durability | | ○ | ○ | ○ | ○ | ○ | X | ○ | ○ | ○ | ○ | ○ | X | ○ |
| | Scuff resistance | | ○ | ○ | ○ | ○ | X | ○ | ○ | ○ | ○ | ○ | ○ | X | ○ |

Type:

I: ionomer resin base

E: polyester base

U: polyurethane base

Total Gauge:

The total of the thickness (mm) of intermediate layer and the thickness (mm) of outer layer Hardness:

Hardness reported in Tables 1 to 3

Flight Performance

The spin rate, carry and total distance for each ball were measured when the ball was struck at a head speed of 40 m/s (HS40) with a driver (W#1), using a swing machine made by Miyamae Co., Ltd. The club used for this purpose was a Tour Stage X500 (made by Bridgestone Sports Co., Ltd.) having a loft of 10 degrees. A ball with a total distance of at least 200 m was rated as good "○" and a total distance of less than 200 m as poor "X."

Controllability:

The spin rate for each ball was measured when the ball was struck with a sand wedge (SW) at a head speed of 20 m/s (HS20). The club used for this purpose was a J's Classical Edition made by Bridgestone Sports Co., Ltd. A ball with a spin rate of 5,900 rpm to 6,500 rpm was rated as good "○,", a spin rate of more than 6,500 rpm as fair "Δ," and a spin rate of less than 5,900 rpm as poor "X."

Feel:

When each ball was actually shot with a driver (W#1) by ten amateur golfers having head speeds of 35 to 45 m/s, the feel of the ball was rated as: good "○" when at least 7 of the 10 golfers thought the feel was good; fair "Δ" when from 5 to 6 of the 10 golfers thought the feel was good; and poor "X" when 4 or fewer of the 10 golfers thought the feel was good.

Durability to Impact:

Each ball was repeatedly struck at random positions with a driver (W#1) at a head speed of 43 m/s. From the average number of impacts required to produce initial cracks on three samples among ten samples, an index of crack-inducing impact was computed based on a value of 100 for the number of crack-inducing impacts to the golf ball of Example 3. Each ball was rated as: good "○" when the index of crack-inducing impact is 97 or greater, and poor "X" when the index of crack-inducing impact is 94 or less.

Scuff Resistance:

The golf balls were temperature conditioned for 4 hours in a 13° C. environment and tested in a chamber at the same temperature. The ball was hit once with a pitching wedge (PW) with angular grooves at a head speed of 40 m/s. The ball was rated as: good "O" when usable again, fair "Δ" when difficult to decide, and poor "X" when no longer usable.

Comparative Example 1, due to a hard outer/soft inner structure wherein the outer layer is hard, receives a short spin on approach shots and gives a poor feel with a putter.

Comparative Example 2, in which the outer layer has a low specific gravity on account of an ionomer resin base composition, has a poor scuff resistance.

Comparative Example 3, in which the intermediate layer absent an inorganic filler has a low specific gravity, has poor durability upon repeated impact.

In Comparative Example 4 in which the intermediate layer has a high specific gravity due to an excess of inorganic filler, the ball has poor rebound and travels a short flight distance.

Comparative Example 5, due to a hard outer/soft inner structure wherein the outer layer is hard, receives a short spin on approach shots and gives a poor feel with a putter.

In Comparative Example 6 in which the total cover gauge is too large, the ball has poor rebound and travels a short flight distance.

In Comparative Example 7, the core has a flat hardness distribution indicating that the hardness at the center is too high. When struck with W#1, the ball receives too much spin and follows a skying trajectory resulting in a short flight distance, and gives too hard a feel.

In Comparative Example 8, the hardness difference between the intermediate layer material and the core surface is negative. When struck with W#1, the ball receives too much spin resulting in a short flight distance. The feel on impact is too hard.

In Comparative Example 9, the hardness difference between the ball surface and the intermediate layer surface is substantially negative, indicating that the intermediate layer is too hard. The durability upon repeated impact is poor and the scuff resistance is worse.

Comparative Example 10, due to a hardness difference of less than 16 between the core surface and the core center, achieves an insufficient reduction of spin on W#1 shot, resulting in a somewhat short flight distance.

The multi-piece solid golf balls of the invention provide a good balance between flight performance, controllability, spin stability, feel, scuff resistance and durability to repeated impact.

What is claimed is:

1. A multi-piece solid golf ball comprising a core, an intermediate layer enclosing the core, and an outer layer enclosing the intermediate layer, characterized in that the intermediate layer is made of a thermoplastic resin composition, the intermediate layer on its surface has a Shore D hardness of at least 57, the intermediate layer has a specific gravity of 1.00 to 1.30 g/cm3, the outer layer has a specific gravity of at least 1.00 g/cm$^3$, the core has a specific gravity of 1.05 to 1.20 g/cm$^3$, the intermediate layer and the outer layer have a total gauge of up to 3.3 mm, the core at its surface and center, the intermediate layer at its surface, and the outer layer at its surface have hardness satisfying: (core surface JIS-C hardness)−(core center JIS-C hardness)]≧16, [(intermediate layer surface JIS-C hardness)−(core surface JIS-C hardness)]≧0, and −18≦[(outer layer surface Shore D hardness)−(intermediate layer surface Shore D hardness)]<0;

wherein the outer layer is made of a polyurethane composition containing (C) a thermoplastic polyurethane and (D) an isocyanate mixture and said isocyanate mixture (D) is a mixture prepared by dispersing (d-1) a compound having as functional groups at least two isocyanate groups per molecule in (d-2) a thermoplastic resin that is substantially non-reactive with isocyanate.

2. The multi-piece solid golf ball of claim 1 wherein the core center has a JIS-C hardness of 54 to 66, and the core surface has a XIS-C hardness of 72 to 95.

3. The multi-piece solid golf ball of claim 1 wherein said thermoplastic resin composition comprises a thermoplastic resin and an inorganic particulate filler in a proportion of 100/5 to 100/25 by weight ratio.

4. The multi-piece solid golf ball of claim 3 wherein said thermoplastic resin composition comprises:

(A) an ionomer resin component which contains (a-1) an olefin/unsaturated carboxylic acid random bipolymer and/or a metal ion neutralization product of an olefin/unsaturated carboxylic acid random bipolymer and (a-2) an olefin/unsaturated carboxylic acid/unsaturated carboxylic acid ester random terpolymer and/or a metal ion neutralization product of an olefin/unsaturated carboxylic acid/unsaturated carboxylic acid ester random terpolymer, and (B) a non-ionomer thermoplastic elastomer.

5. The multi-piece solid golf ball of claim 3 wherein said thermoplastic resin composition comprises:

(A) an ionomer resin component which contains (a-1) an olefin/unsaturated carboxylic acid random bipolymer and/or a metal ion neutralization product of an olefin/unsaturated carboxylic acid random bipolymer and (a-2) an olefin/unsaturated carboxylic acid/unsaturated carboxylic acid ester random terpolymer and/or a metal ion neutralization product of an olefin/unsaturated carboxylic acid/unsaturated carboxylic acid ester random terpolymer in a proportion (a-1)/(a-2) of 100/0 to 25/75 by weight ratio, and (B) a non-ionomer thermoplastic elastomer in a proportion (A)/(B) of 100/0 to 50/50 by weight ratio.

6. The multi-piece solid golf ball of claim 1 wherein [(core surface JIS-C hardness)−(core center JIS-C hardness)]≧20.

7. The multi-piece solid golf ball of claim 1 wherein the core includes an organosulfur compound.

8. A multi-piece solid golf ball comprising a core, an intermediate layer enclosing the core, and an outer layer enclosing the intermediate layer, characterized in that the intermediate layer is made of a thermoplastic resin composition, the intermediate layer on its surface has a Shore D hardness of at least 57, the intermediate layer has a specific gravity of 1.00 to 1.30 g/cm$^3$, the outer layer has a specific gravity of at least 1.00 g/cm$^3$, the core has a specific gravity of 1.05 to 1.20 g/cm$^3$, the intermediate layer and the outer layer have a total gauge of up to 3.3 mm, the core at its surface and center, the intermediate layer at its surface, and the outer layer at its surface have hardness satisfying: [(core surface JIS-C hardness)−(core center JIS-C hardness)]≧16, [(intermediate layer surface JIS-C hardness)−(core surface JIS-C hardness)]≧0, and −18≦([(outer layer surface Shore D hardness)−(intermediate layer surface Shore D hardness)]<0;

wherein said core has a two-layer structure.

9. The multi-piece solid golf ball of claim 8 wherein the core center has a JIS-C hardness of 54 to 66, and the core surface has a JIS-C hardness of 72 to 95.

10. The multi-piece solid golf ball of claim 8 wherein said thermoplastic resin composition comprises a thermoplastic resin and an inorganic particulate filler in a proportion of 100/5 to 100/25 by weight ratio.

11. The multi-piece solid golf ball of claim 10 wherein said thermoplastic resin composition comprises:

(A) an ionomer resin component which contains (a-1) an olefin/unsaturated carboxylic acid random bipolymer and/or a metal ion neutralization product of an olefin/unsaturated carboxylic acid random bipolymer and (a-2) an olefin/unsaturated carboxylic acid/unsaturated carboxylic acid ester random terpolymer and/or a metal ion neutralization product of an olefin/unsaturated carboxylic acid/unsaturated carboxylic acid ester random terpolymer, and (B) a non-ionomer thermoplastic elastomer.

12. The multi-piece solid golf ball of claim 10 wherein said thermoplastic resin composition comprises:

(A) an ionomer resin component which contains (a-1) an olefin/unsaturated carboxylic acid random bipolymer and/or a metal ion neutralization product of an olefin/unsaturated carboxylic acid random bipolymer and (a-2) an olefin/unsaturated carboxylic acid/unsaturated carboxylic acid ester random terpolymer and/or a metal ion neutralization product of an olefin/unsaturated carboxylic acid/unsaturated carboxylic acid ester random terpolymer in a proportion (a-1)/(a-2) of 100/0 to 25/75 by weight ratio, and (B) a non-ionomer thermoplastic elastomer in a proportion (A)/(B) of 100/0 to 50150 by weight ratio.

13. The multi-piece solid golf ball of claim 8 wherein [(core surface JIS-C hardness)−(core center JIS-C hardness)]≧20.

14. The multi-piece solid golf ball of claim 8 wherein the core includes an organosulfur compound.

* * * * *